US006207931B1

(12) United States Patent
Löser et al.

(10) Patent No.: US 6,207,931 B1
(45) Date of Patent: Mar. 27, 2001

(54) METHOD FOR THE HEAT TREATMENT OF WORKPIECES

(75) Inventors: Klaus Löser, Mainhausen (DE); Wilfried Zenker, E-Hartland, CT (US)

(73) Assignee: ALD Vacuum Technologies AG, Hanau (DE)

( * ) Notice: Subject to any disclaimer, the term of this patent is extended or adjusted under 35 U.S.C. 154(b) by 0 days.

(21) Appl. No.: 09/584,815

(22) Filed: May 31, 2000

Related U.S. Application Data

(62) Division of application No. 09/178,290, filed on Oct. 23, 1998.

(30) Foreign Application Priority Data

Oct. 24, 1997 (DE) ..... 197 47 018

(51) Int. Cl.[7] ..... F27B 9/06

(52) U.S. Cl. ..... 219/388; 34/661; 432/9; 432/11; 432/243

(58) Field of Search ..... 219/388, 521, 219/69.2; 392/417; 432/9, 11, 123, 128, 143, 146, 147, 243; 34/266, 273, 420, 451, 498, 500, 614, 661, 664, 216, 217, 236; 266/149; 62/63; 228/219

(56) References Cited

U.S. PATENT DOCUMENTS

| | | | | |
|---|---|---|---|---|
| 3,609,295 | * | 9/1971 | Bielefeldt | 219/388 |
| 3,673,678 | * | 7/1972 | Moreau et al. | 228/219 |
| 3,697,725 | * | 10/1972 | Bielefeldt | 219/388 |
| 3,767,381 | * | 10/1973 | Bielefeldt | 266/149 |
| 4,086,050 | | 4/1978 | Luiten et al. . | |
| 4,610,886 | * | 9/1986 | Buller-Colthurst | 34/216 |
| 4,886,449 | * | 12/1989 | Brittin | 432/11 |
| 4,963,710 | * | 10/1990 | Lach | 219/69.2 |
| 5,039,841 | * | 8/1991 | Kato et al. | 219/388 |
| 5,154,338 | * | 10/1992 | Okuno et al. | 219/388 |
| 5,163,599 | * | 11/1992 | Mishina et al. | 219/388 |
| 5,273,585 | | 12/1993 | Luiten et al. . | |
| 5,630,322 | * | 5/1997 | Heilmann et al. | 62/63 |
| 5,871,806 | | 2/1999 | Shoga et al. . | |

FOREIGN PATENT DOCUMENTS

| | | |
|---|---|---|
| 2117398 | 1/1972 | (DE) . |
| 2501360 | 12/1978 | (DE) . |
| 3233612 | 3/1984 | (DE) . |
| 4110114 | 10/1991 | (DE) . |

* cited by examiner

*Primary Examiner*—Teresa Walberg
*Assistant Examiner*—Fadi H. Dahbour
(74) *Attorney, Agent, or Firm*—Fulbright & Jaworski, LLP

(57) ABSTRACT

An apparatus for the heat treatment of workpieces comprising comprising a plurality of evacuable chambers connected through airlocks, a conveyor, preferably a circular chain conveyor for the transport of the workpieces along a path through the chambers, an electric resistance heating device, a cooling blower, and a heat exchanger, a plurality of workpieces of equal size and configuration, in particular backsaw blades, are placed tightly one on top of another and form a stack which is placed into a frame made of profile cuts, whereby the frame is capable of being coupled to a conveyor by means of suspension elements.

5 Claims, 4 Drawing Sheets

METHOD FOR THE HEAT TREATMENT OF WORKPIECES

Figure 1:
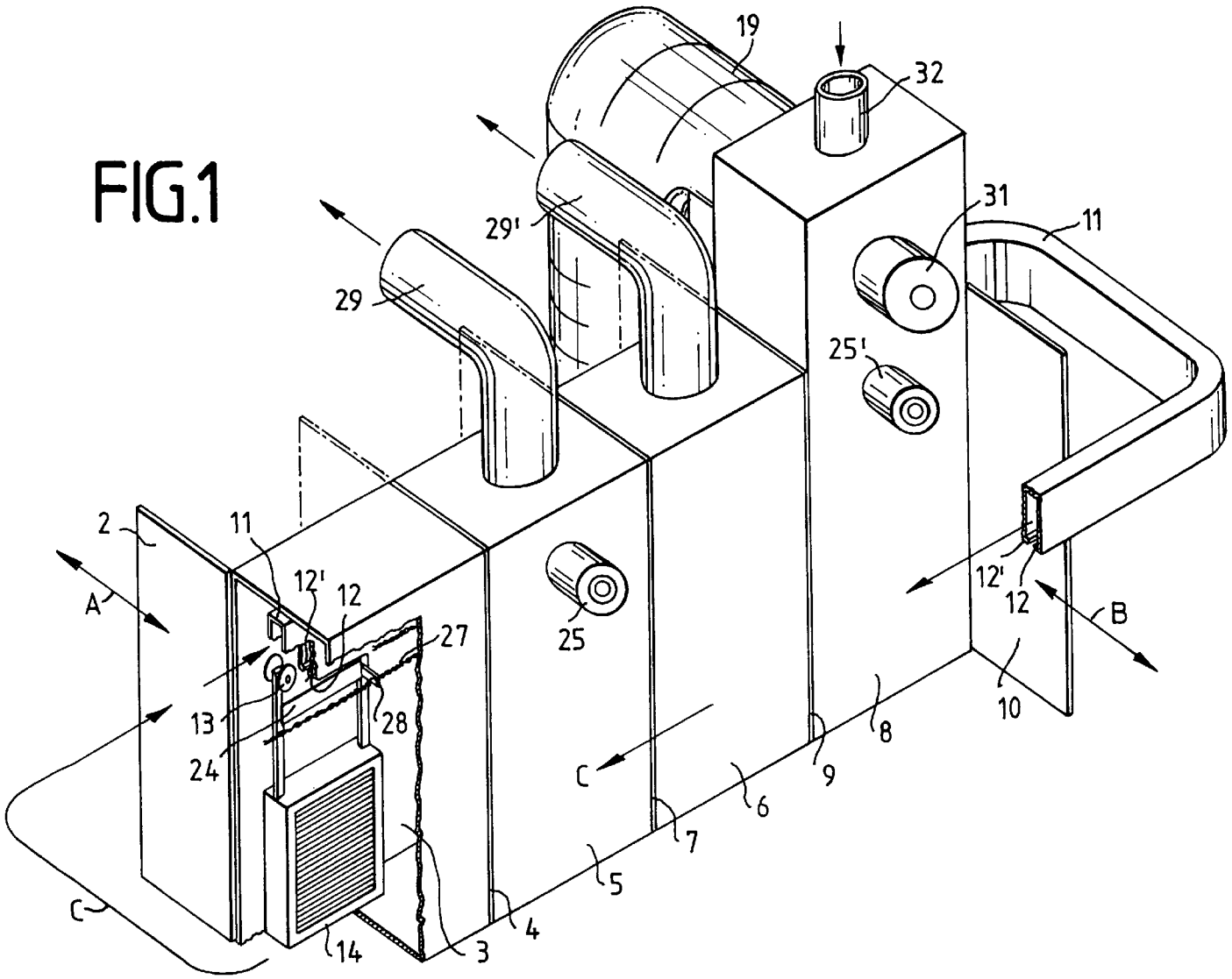

This application is a division of Ser. No. 09/178,290, filed Oct. 23, 1998.

The invention relates to an apparatus for the heat treatment of workpieces with a plurality of evacuable chambers connected through airlocks, a conveyor, preferably a circular chain conveyor, for the transport of the workpieces along a path through the chambers, an electric resistance heating device, a cooling blower, and a heat exchanger.

An apparatus for the heat treatment of workpieces is known (DE 41 10 114) comprising a carburization zone, a quenching zone and a nitrating zone, which zones are designed in series, forming a continuous passage for the steel parts being transported, said passage being divided by doors, and where the quenching zone has a device for forced cooling of the steel parts.

Furthermore, a system is known for the continuous metallurgical treatment of various materials in low pressure conditions or in vacuum and under high temperature, for example ferro-alloys (OS 15 38 276), where in a low-pressure chamber a separate heating arrangement is provided, said arrangement being equipped with thermal insulation and heating elements, said low-pressure chamber being equipped with a pressure equalization chamber which is connected with said low pressure chamber and which can be separated from it for the loading and removal of the material, where in each of the above-named chambers devices necessary for the process are arranged and which devices are advantageously remote-controlled centrally.

There is further known an continuous-use electric oven (DE 32 33 361) for the heat treatment of steel objects, having a horizontally operating transport mechanism, an anterior pre-heating chamber, a heat treatment chamber which is arranged on top of a loading chamber with a vertically operating supply, and a posterior quenching chamber, whereby the heat treatment chamber is capable of being hermetically separated from the loading chamber by means of a floor, and the loading chamber is capable of being separated from the heating chamber by means of heat shields whereby the floor of the preheating chamber and the floor of the quenching chamber upon which floors the steel objects can be moved forward, are movable forward and back in relation to one another such that the steel objects, in connection with retractable stops located in front of and behind the loading chamber, are capable of being moved both onto and from the vertically operating conveyor as well as being capable of being moved up into the heat treatment chamber by the conveyor together with the floor.

Finally there is known a vacuum atmospheric oven for the heat treatment of workpieces with a heat chamber in which a fan is arranged for the circulation of the atmosphere (DAS 25 01 360), where a second fan is added to the fan for the mixing of the atmosphere while avoiding forced circulation, whereby the rotation speed and/or direction of both fans can be changed.

The object of the present invention is to provide an apparatus of the type in question which is suitable for the heat treatment of relatively thin-walled and narrow workpieces, in particular saw blades, while avoiding deformation of the workpieces as a result of the treatment. The apparatus is to be designed such that a large number of workpieces can be treated simultaneously and that the workpieces can be rapidly introduced into the apparatus for said treatment and/or rapidly removed from it after the completed treatment. Finally, the apparatus is to operate without a device which would make holding and securing of each individual workpiece necessary and would require for this purpose a special mount for each workpiece.

According to the invention this object is achieved in that a plurality of workpieces of equal size and configuration, for example hacksaw blades, are placed, lying closely together and forming a compact block, into an upwardly open frame constructed of profile sections, whereby the frame can be coupled to a conveyor by means of suspension elements.

Additional features and details are characterized and described in more detail in the subordinated claims.

Figure 2:
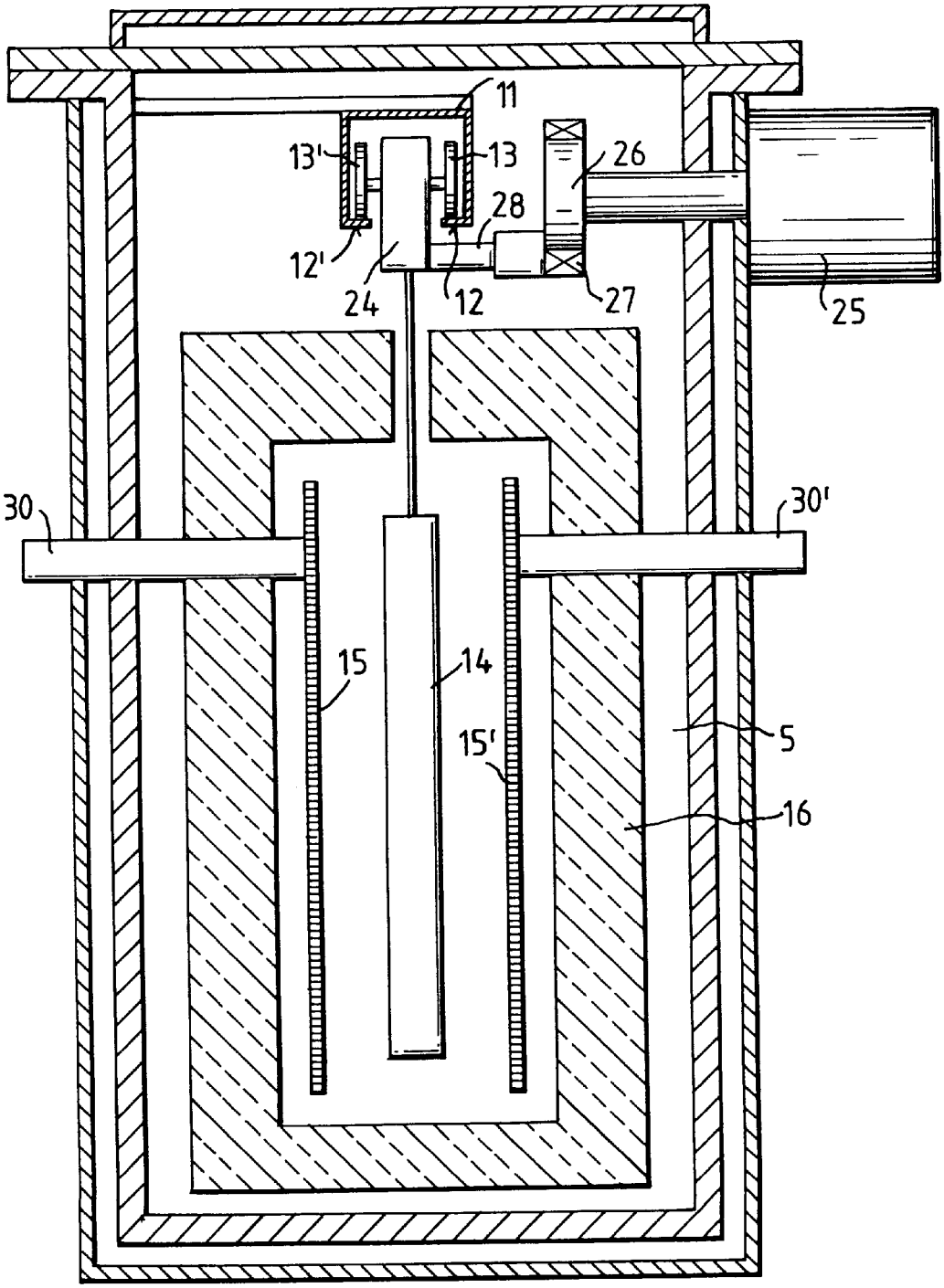
Figure 3:
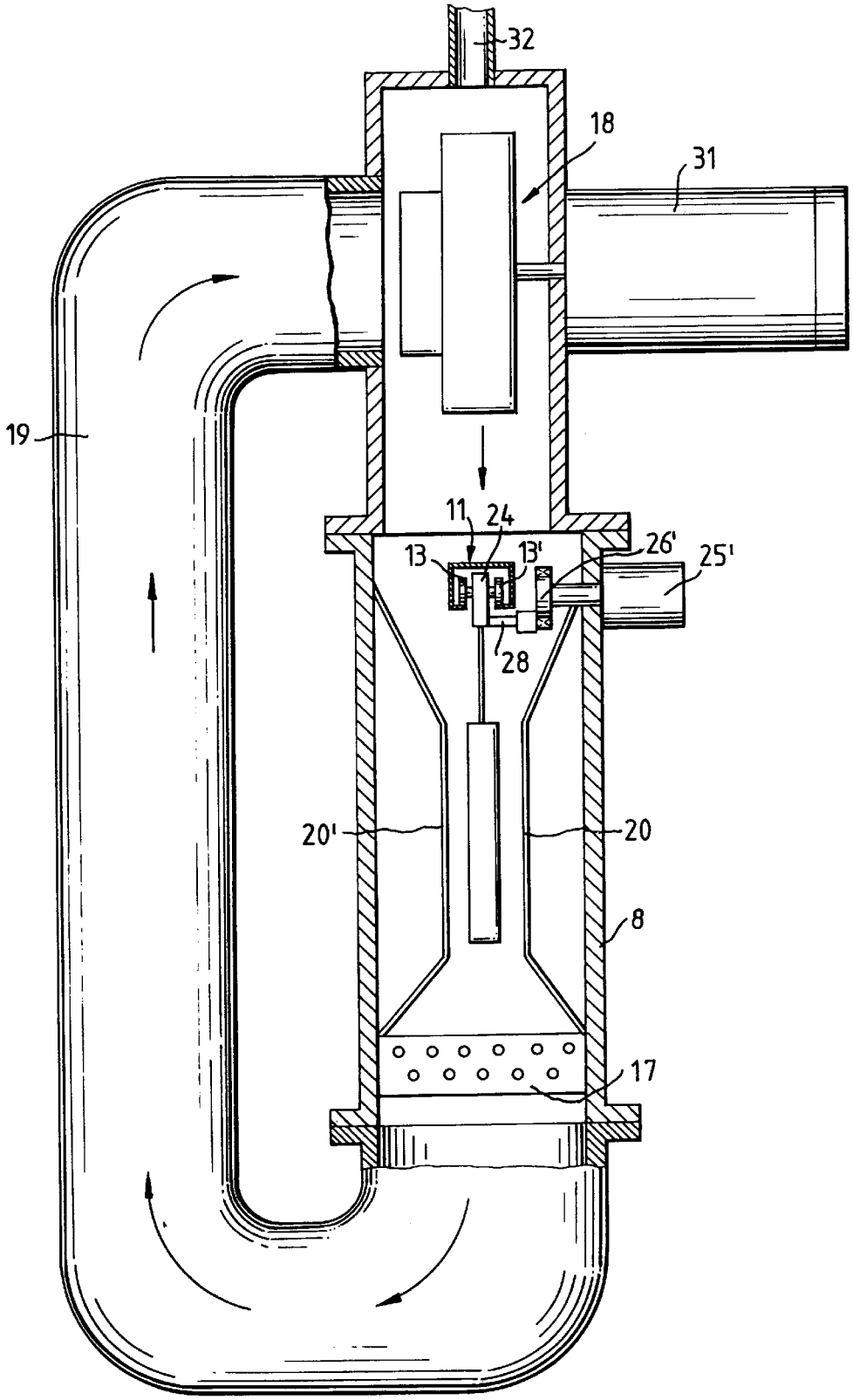
Figure 4:
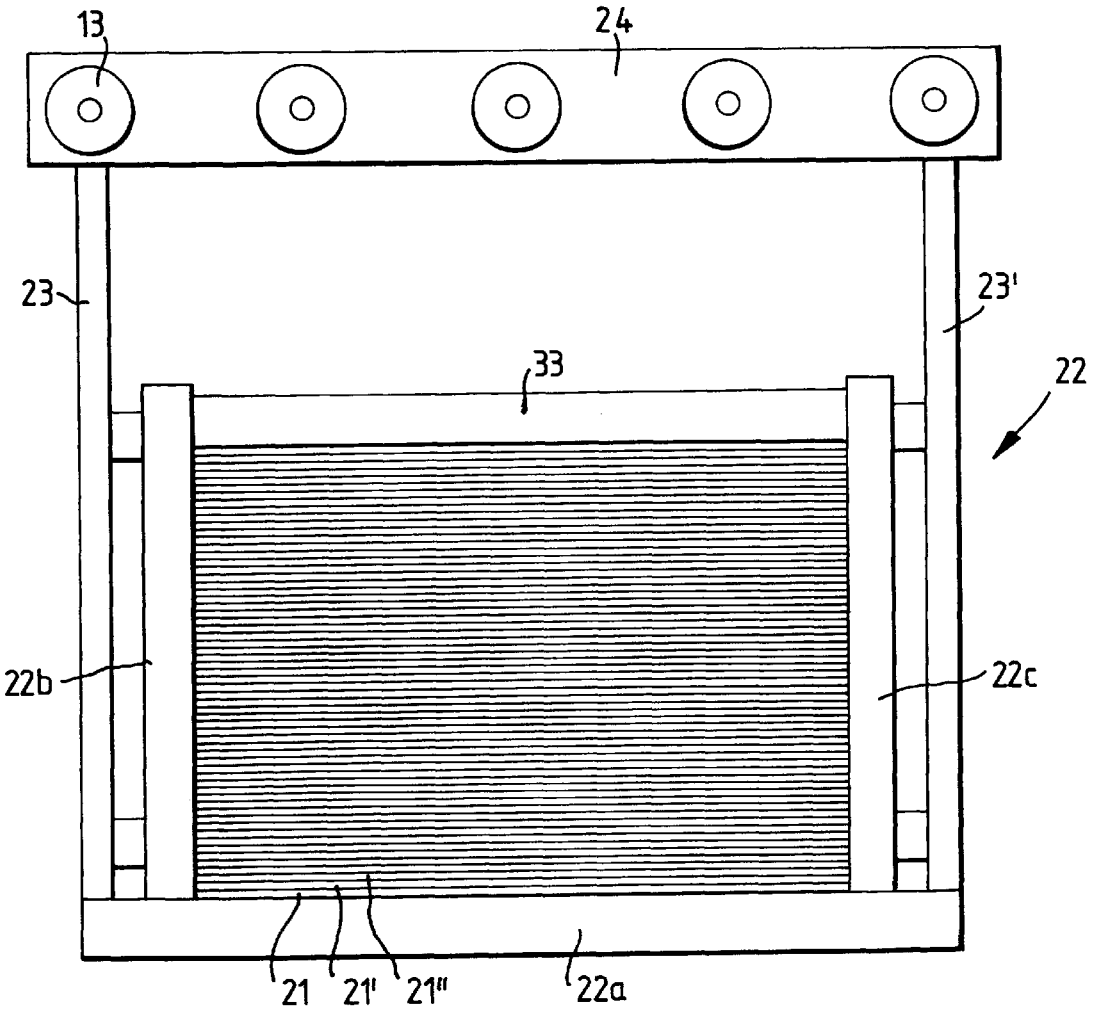

The invention allows for great variety of embodiments, one of which is shown schematically in the appended drawings which show:

in FIG. 1, in a simplified perspective drawing and partially in section, the apparatus according to the invention, with a loading chamber, a preheating chamber, a heat treatment chamber and a quenching chamber, in FIG. 2, a cross section of the preheating chamber according to FIG. 1, in FIG. 3, a cross section of the quenching chamber according to FIG. 1, and in FIG. 4, a front view of the frame with a stack of saw blades held by said frame.

The apparatus for the heat treatment of workpieces substantially comprises a loading chamber 3 with a loading gate 2, a preheat chamber 5 arranged serially behind said loading chamber 3 and separated from it by a gate 4, a heat treatment chamber 6 arranged serially behind said preheat chamber 5 and capable of being separated from it by a gate 7, a quenching chamber 8 with gates 9 and 10, arranged serially behind the heat treatment chamber 6, a track 11 extending through all chambers 3, 5, 6, 8, said track having runner surfaces 12, 12' extending horizontally from the side portions of the track to accommodate the roller pairs 13, . . . of the frame-like workpiece holders 14, . . . , the heating elements 15, 15' arranged in the preheat chamber 5 and enclosed by a well-shaped heat shield 16, a heat exchanger 17 arranged in the quenching chamber 8, and a blower 18 with blower duct 19 and deflector panels 20, 20'.

The individual workpieces, for example saw blades 21, . . . together form a stack which is held by a frame 22 constructed of profile sections, which frame in turn is mounted on a yoke 24 by means of a vertically extending brace 23, 23', said yoke being provided with several roller pairs 13, 13', . . . The yoke 24, with the stack of saw blades 21, 21', . . . suspended from it, is movable along a track 11 which extends through all chambers 3, 5, 6, 8. Said track is approximately U-shaped where both legs are provided with runner surfaces 12, 12' for the roller pairs 13, 13', . . . and said surfaces being part of a circular conveyor. For the heat treatment, the stack of saw blades 21, 21', . . . is moved by the yoke 24 through the chambers 3, 5, 6, 8 for which movement there are arranged on the side walls of the chambers 8 [sic] parallel shafts with gear wheels 26, . . . driven by motors 25, 25', . . . , with a chain 27 extending over the gear wheels 26, . . . , said chain being capable of coupling, by mean of the catches 28, . . . with said yoke 24 and transporting the frame(s) 22, . . . through the chambers 3, 5, 6, 8.

Once a saw blade stack 21, 21', . . . has been loaded into the first chamber 3, the chamber is closed off by the gate 2 so that subsequently the opening of the gate 4 can take place, said gate 4 being connected via a pipe conduit 29 to a vacuum pump, and so that the heating up to the treatment temperature of the saw blades 21, 21', . . . can proceed in the chamber 5 under vacuum conditions, after the gate 4 has first been closed. The preheat chamber 5, shown schematically in FIG. 2, has heating elements 15, 15' which are connected to an electrical power source via plate lugs 30, 30'. Once the saw blades stack 21, 21', . . . has reached the desired operating temperature it can be introduced into the chamber 6 which is designed similar to chamber 5 and is connected to a vacuum pump via a pipe conduit 29'. Said stack can remain in chamber 5 for some time at the treatment temperature and under vacuum conditions. Finally the stack is introduced into the quenching chamber 8, the construction of which is shown in more detail in FIG. 3. Said chamber 8 is equipped with a blower 18 which is driven by a motor 31, and has deflector panels 20, 20' which, in the vicinity of the stack, accelerate the quenching gas in the direction indicated by the arrow and then direct said gas to a heat exchanger 17. The quenching gas can be fed into the chamber 8 through fittings 32 and can be drawn off after the cooling process by a pump (not shown) or by a vacuum pump connected to the pipe conduits 29, 29'. After the completed quenching process the stack, suspended on track 11, can be removed from the apparatus in the direction of arrow C through the open gate 10.

A particular advantage of the frame 14 is that the saw blades which are placed one on top of another to form a stack are on the one hand prevented by their own weight from deforming, and on the other can be kept at a temperature which remains approximately stable. To ensure that the blades uppermost in the stack are not also subjected to deformation, the stack 21, 21', . . . is weighted down by a weight 33 which has a length and a width approximately equal to that of the blades and which can be placed into the frame parts 22*b*, 22*c* formed from U-shaped profile sections.

What is claimed is:

1. A method for the heat treatment of sawblades of equal size and configuration comprising the steps of:

(a) heating said sawblades in a substantially oxygen free heating chamber;

(b) transporting, via a conveyor, said sawblades along a path from said heating step to a quenching chamber;

(c) quenching said sawblades in said quenching chamber with a cooling blower and a heat exchanger;

wherein said quenching and heating steps are accomplished via a frame means connected by suspension elements to said conveyor and having a compact block to ensure that said sawblades are lying closely on top of one another so as to provide even heating of said sawblades.

2. The method according to claim 1, wherein said quenching and heating steps are accomplished via said frame means and further involve the step of holding the ends of the sawblades that side parts of said sawblades are connected to the conveyor by means of suspension elements.

3. The method according to claim 1, further involving the steps of:

forming a stack from said sawblades; and weighing down the stack by a prism-shaped weight placed on an uppermost sawblade and held by side parts of said frame means.

4. The method according to claim 1, further involving the steps of transporting the sawblades held by said frame means through the chambers such that said sawblades are longitudinally aligned along a direction of the transport and positioning the suspension elements of said frame means are upwardly such that a yoke of said frame means is located outside of an effective zone of heating elements of the heating chamber.

5. The method according to claim 1, further comprising the step of directing a cooling gas stream directly past the path of the sawblades from above a conveyor and providing the heat exchanger below a space provided for passage of the sawblades.

* * * * *